US005823235A

United States Patent [19]

Alley et al.

[11] Patent Number: 5,823,235

[45] Date of Patent: Oct. 20, 1998

[54] EMERGENCY SHUT-OFF MECHANISM FOR PROPANE DELIVERY SYSTEMS AND THE LIKE

[75] Inventors: Lewis F. Alley, Kansas City; Billy F. Brim, Liberty, both of Mo.

[73] Assignee: A-B Products, Inc., Liberty, Mo.

[21] Appl. No.: 819,758

[22] Filed: Apr. 3, 1997

[51] Int. Cl.[6] ..... B65B 3/00

[52] U.S. Cl. ..... 141/197; 141/21; 141/94; 141/231; 137/456; 137/460

[58] Field of Search ..... 141/3, 4, 18, 21, 141/94, 197, 231; 137/456, 460

[56] References Cited

U.S. PATENT DOCUMENTS

| | | | |
|---|---|---|---|
| 3,612,081 | 10/1971 | Williams | 137/460 |
| 4,074,692 | 2/1978 | Shafer | 137/460 |
| 4,223,692 | 9/1980 | Perry | 137/460 |
| 4,355,654 | 10/1982 | Levesque et al. | 137/460 |
| 4,360,046 | 11/1982 | Streit et al. | 141/231 |
| 4,518,955 | 5/1985 | Meyer | 137/460 |
| 5,251,653 | 10/1993 | Tucker et al. | 137/460 |
| 5,287,884 | 2/1994 | Cohen | 137/460 |
| 5,349,992 | 9/1994 | Gallo et al. | 141/18 |

OTHER PUBLICATIONS

Greer Hydraulics Brochure No. F264–689, entitled "Bladder Accumulators", all pages (1989).

Custom Control Sensors, Inc. Catalog No. 830B 20M, entitled "CCS Dual–Snap Composite Catalog", front and back coversheets and pp. 1–2 and 11–12 (Mar., 1991).

Precision Dynamics, Inc. Catalog, entitled "Miniature Valves and Controls", all pages (Mar., 1994).

SSAC, Inc. Catalog No. B002–2/95, entitled "SSAC", front and back coversheets and pp. 4–5 (Feb., 1995).

Advanced Fuel Components, Inc. Brochure, entitled "Performance Engineered, Filters & Solenoid Valves", all pages (publication date unknown).

Advanced Fuel Components, Inc. Leaflet No. AFC 151, entitled "High Pressure Multi–purpose Shut–Off Valve", (publication date unknown).

*Primary Examiner*—J. Casimer Jacyna

*Attorney, Agent, or Firm*—Hovey, Williams, Timmons & Collins

[57] ABSTRACT

A safety shut-off system especially adapted for propane delivery trucks and the like utilizes a pressure differential switch to immediately close the outlet valve of the cargo tank in the event that the differential between an initial reference pressure in the system and the current delivery pressure becomes high enough. When the delivery process is started, both sides of the pressure differential switch are simultaneously exposed to the delivery pressure so that the switch remains in a standby condition. As the delivery pressure becomes stabilized, a timer closes a trapping valve on the high pressure side of the pressure differential switch, trapping a quantity of fluid against the high pressure side of the switch to comprise a reference pressure. The other side of the switch remains in open communication with the delivery pressure so that, if the delivery pressure should abruptly fall, the higher, pre-established reference pressure on the high pressure side of the switch causes the switch to be operated, closing the shut-off valve.

7 Claims, 1 Drawing Sheet

EMERGENCY SHUT-OFF MECHANISM FOR PROPANE DELIVERY SYSTEMS AND THE LIKE

TECHNICAL FIELD

The present invention relates to the field of fluid delivery systems such as, for example, truck-mounted systems in which a large cargo tank on the truck is used to refill various smaller containers at multiple delivery sites using a hose through which the fluid is pumped from the truck to the container. More particularly, the present invention relates to a safety shut-off system capable of instantly closing the main outlet valve of the cargo tank in the event of a sudden drop in line pressure in the delivery hose or other conduit such as might occur if there is a rupture or break in the line.

BACKGROUND

Propane delivery trucks have heretofore been provided with excess flow valves which are intended to shut down the system in the event of a rupture in the delivery line leading from the tank. However, because such systems have typically employed positive displacement pumps driven by the engine of the truck, such pumps cannot exceed a certain displacement at a given engine rpm, regardless of whether there is back pressure downstream from the pump as would normally exist during the loading process, or the absence of any back pressure as would occur in the event of a rupture in the line downstream from the pump. Thus, the excess flow valve, which would be set to close at a high volume of flow, is never actuated because the positive displacement pump will not allow the flow to reach that high rate. Consequently, the propane or other fluid continues to be pumped through the ruptured line and out into the atmosphere.

SUMMARY OF THE PRESENT INVENTION

Accordingly, one important object of the present invention is to provide a safety shut-off system which is based not upon flow volume or flow rate, but rather upon changes in pressure in the delivery system. In this regard, it has been determined that when a rupture occurs, there will be a detectable pressure drop in the system, even though the volume displaced may go unchanged. Thus, by providing a safety shut-off system which is activated by a pressure drop, the shut-off valve can be closed automatically even though the volume of gas or fluid displaced per unit of time has not changed.

Different delivery systems and fill containers have different characteristics. Moreover, as the main cargo tank on the truck is progressively depleted, the delivery pressure may vary from one site to another. The ambient temperature is also a significant factor.

Thus, instead of a system which is triggered by the delivery pressure dropping to a certain lower level, the present invention is triggered by the magnitude of the drop compared to a reference pressure established for that particular delivery job. In other words, the differential between the delivery pressure at steady-state operation and the pressure when a rupture occurs is the triggering event. Regardless of how high or low the pressure might be under steady-state conditions, the safety shut-off system will not be triggered unless a certain, predetermined differential between that pressure and the pressure at rupture is obtained.

Because it typically requires some significant period of time after starting a delivery job for the system pressure to stabilize, the shut-off system of the present invention delays determining the reference pressure for that particular delivery job until a predetermined initial amount of time has elapsed. A timer in the system waits until a predetermined amount of time has elapsed and then causes a small volume of the fluid being pumped to be trapped on one side of a pressure differential switch of the system. The other side of the switch remains in open communication with the delivery line throughout the job. So long as the pressure remains substantially the same on both sides of the switch, the switch will remain unactuated. However, if the side in open communication with the delivery line experiences a pressure drop from a line rupture or otherwise, the trapped volume of fluid at higher pressure on the other side of the switch will cause the switch to be actuated, provided that the differential between the reference pressure and the line pressure is great enough. This, in turn, will close the shut-off valve at the truck.

BRIEF DESCRIPTION OF THE DRAWING

The single FIG. 1 is a schematic representation of a safety shut-off system embodying the present invention and used in combination with the delivery system of a fluid delivery truck or the like.

DETAILED DESCRIPTION

Figure 1:
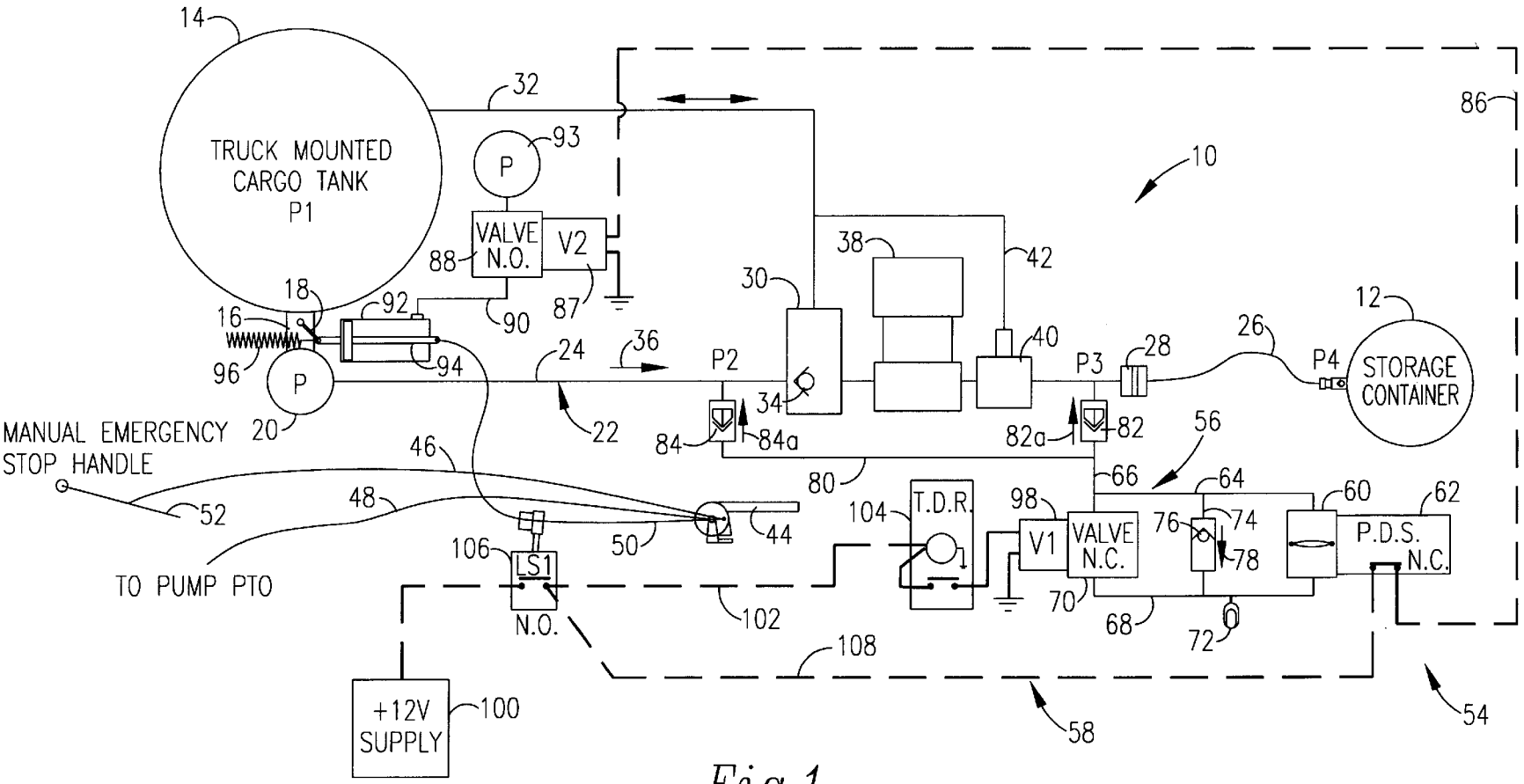

The apparatus broadly denoted by the numeral 10 in FIG. 1 is, in a preferred embodiment, all mounted upon a transport or delivery truck, with the exception of the storage tank 12, which is normally located at the delivery site. As will be appreciated, although the principles of the present invention are particularly well suited for use in connection with the delivery of propane and other such gases normally transported in liquid form, the concepts of the invention in their broadest respects are not limited to such fields. Thus, although the following description of a preferred embodiment refers to truck based systems and to propane as the media being delivered, the principles of the present invention are broader than that.

The truck or other transporting device (not shown) has a cargo tank 14 that carries the supply of propane to be delivered to a number of different storage tanks 12 at different locations. An outlet 16 at the bottom of the cargo tank 14 is controlled by a shut-off valve 18, which permits or stops flow from the tank 14 depending upon whether the valve 18 is opened or closed. A positive displacement pump 20 receives liquid propane from the outlet 16 when the valve 18 is open and moves it along a conduit 22 toward the receiving container 12. Although the term "conduit" is used herein to describe the entire line between the pump 20 and the storage container 12, in actual practice the conduit 22 will normally include a rigid pipe 24 as an immovable portion of the conduit on the truck, and a flexible hose 26 coupled with the pipe 24 via a rotating joint 28. The flexibility of the hose 26 and the rotatability of the joint 28 permit the operator to appropriately manipulate the conduit 22 in a way to establish secure connection to the receiving container 12.

The pipe 24 has a vapor release mechanism 30 that also communicates with the cargo tank 14 via a line 32. A check valve 34 associated with the vapor release mechanism 20 allows flow through the pipe 24 only in the direction of the arrow 36, i.e., only away from the cargo tank 14 and toward the storage container 12. A meter 38 in the pipe 24 keeps track of the volume of fluid delivered through the conduit 22, and a differential valve 40 is located on the downstream side of the meter 38 in communication with the pipe 24. A line 42 leads from the differential valve 40 to the vapor release line 32.

One or more hand levers 44 on the truck is connected via operating cables 46, 48 and 50 to various parts of the system for manipulating such components. In this respect, the cable 46 leads to a manual emergency stop handle 52 that can actually be used to throw the lever 44 back into its standby position in the event of an emergency. The cable 48 leads to the power take-off shaft from the track engine so as to establish an operating connection between that shaft and the pump 20, thereby activating the pump 20. The cable 50 leads to the shut-off valve 18 and is capable of shifting the valve 18 between opened and closed positions. As will be explained below, the safety shut-off system of the present invention is capable of overriding the hand lever 44 so as to close the shut-off valve 18 even when the lever 44 is in a position to maintain the valve 18 open.

The safety shut-off system of the present invention is broadly designated by the numeral 54 and includes two different, but cooperating circuits, i.e., a pressure differential detecting circuit 56 and an operating circuit 58. The detecting circuit 56 is a fluid flow circuit connected in parallel flow relationship with the conduit 22. Thus, during delivery, the detecting circuit 56 is exposed to the delivery pressure within the conduit 22. A key component of the detecting circuit 56 is an actuator 60 that is responsive to pressure differential on opposite sides of an internal component to cause the actuator to be disposed in either a standby or an operated condition. As will become apparent, the actuator 60 is operably associated with a pressure differential electrical switch 62 comprising part of the operating circuit 58. In practice, the actuator 60 and the switch 62 may be assembled together into a common body to present a single unit or component. One commercially available such unit is the Model 604D1 available from the Custom Control Sensors Inc. of Chatsworth, Calif.

The actuator 60 has a line 64 leading from one side thereof which connects to another line 66 joined with the pipe 24 downstream from the differential valve 40 and upstream from the rotating joint 28. Another line 68 leads from the opposite side from the actuator 60 to a normally closed electrically powered trapping valve 70 in the line 66. Thus, the trapping valve 70 and the actuator 60 are disposed in parallel fluid flow relationship such that both are simultaneously exposed to delivery pressure in the conduit 22 via the line 66. When the trapping valve 70 is open, the pressure differential valve 60 is exposed to the pressure in line 66 via both of the lines 64,68 so that the pressure is the same on opposite sides of the actuator 60. On the other hand, when the trapping valve 70 is closed, the path between the trapping valve 70 and the corresponding side of the actuator 60 is closed off from the delivery pressure in the conduit 22.

The detecting circuit 56 further includes an optional accumulator 72 which may be employed to help maintain a constant reference pressure within the trapping line 68 during such time as the actuator 60 is changed from a standby condition to an operated condition as subsequently explained. In addition, a by-pass line 74 around the trapping valve 70 may be provided in which a one way check valve 76 is disposed. The check valve 76 is designed to permit flow only in the direction of the arrow 78, thus permitting the trapping line 68 to be charged with additional pressurized fluid from line 66 but precluding the discharge of pressurized fluid from the trapping line 68.

Additionally, the detecting circuit 56 includes a line 80 that interconnects the line 66 and the pipe 24 at a point upstream from the check valve 34. Thus, lines 80 and 66 join with the pipe 24 on opposite upstream and downstream sides of the check valve 34. A pair of one way restrictor check valves 82 and 84 are provided in the lines 66 and 80 respectively. These two checks 82, 84 are operable to be fully open for flow in the direction of the respective arrows 82*a* and 84*a* and to permit only restricted flow in the opposite direction. In the preferred embodiment, the restrictor check valves 82 and 84 are designed to present a maximum orifice size of 0.055 inches in the direction opposite to the arrows 82*a* and 84*a*.

The operating circuit 58 is, in the preferred embodiment, an electrical circuit in which the pressure differential switch 62 is a primary component, as described above. The pressure differential switch 62 is normally closed. The normally closed condition of the pressure differential switch 62 corresponds to the standby condition of the actuator 60 of the detector circuit 56. An electrical conductor 86 connects the pressure differential switch 62 with an electrically operated air valve 88 controlling an air line 90 into a cylinder 92. Depending upon the position of the air valve 88, air will be supplied to the cylinder 92 by an air pump 93, where it will be trapped within the cylinder 92, or it will be exhausted from the cylinder 92. The cylinder 92 is mechanically coupled at one end with the shut-off valve 18, while an internal ram 94 is connected to the operating lever 44 via the cable 50. When air is trapped within the cylinder 92 so as to hold the ram 94 in a retracted position, operation of the lever 44 will shift the entire ram cylinder 92 assembly, causing the shut-off valve 18 to be moved to the open position. On the other hand, when the lever 44 is turned in the opposite direction, the ram/cylinder assembly will be shifted by the cable 50 to move the shut-off valve 18 to a closed position. In the event that the lever 44 is in a position to maintain the valve 18 open, de-energizing the air valve 88 by opening of the pressure differential switch 62 will cause air within the cylinder 92 to be exhausted to the atmosphere, thus permitting a return spring 96 to pull the shut-off valve 18 to a closed position, along with the cylinder 92. While the cylinder 92 and the ram 94 have been illustrated in one preferred embodiment of the invention, it will be understood that many different types of actuating devices for the shut-off valve 18 would be suitable.

The operating circuit 58 also includes a solenoid 98 for opening and closing the trapping valve 70. The solenoid 98 is connected to a source of electrical potential 100 via a conductor 102. A normally open time delay relay 104 controls electrical access of the solenoid 98 to the source of electrical potential 100. Additionally, a normally open switch 106 between the time delay relay 104 and the source of potential 100 controls access of the relay 104 to the source of potential 100. The switch 106 is mechanically operated by the cable 50 such that the cable 50 opens the shut-off valve 18 and closes the switch 106 at the same time.

OPERATION

Once the operator has connected the hose 26 to the storage container 12, he may then energize the apparatus 10 to commence delivery of the propane or other fluid stored in the cargo tank 14. By throwing the lever 44 in the appropriate direction, the operator opens the shut-off valve 18 via the cable 50. Simultaneously, this closes the switch 106 to energize the operating circuit 58 of the safety shut-off system 54. When switch 106 becomes closed, a conductor 108 establishes a closed circuit path to the conductor 86 via the normally closed pressure differential switch 62 so that the normally open solenoid 87 of air valve 88 is actuated.

This causes the valve 88 to direct air into the air cylinder 92. This allows the shut-off valve 18, which has been opened by lever 44 and the cable 50, to remain open.

Closing of the switch 106 also starts the time delay relay 104 and closes its internal contacts so as to connect the solenoid 98 of the trapping valve 70 with the source of electrical potential 100. Consequently, current is supplied through the time delay relay 104 to the solenoid 98 which opens the normally closed trapping valve 70. Thus, pressurized fluid in conduit 22 is communicated to both sides of the actuator 60 via line 64 and line 68 so that the actuator 60 sees the pressure on both sides and remains in its standby condition with the pressure differential switch closed.

When the time delay relay 104 times out, its internal contacts open, causing the solenoid 98 to be returned to its non-operated position, closing the trapping valve 70. Consequently, fluid is trapped in the line 68 between the trapping valve 70 and the high pressure side of the actuator 60. This becomes the reference pressure for the detecting circuit 56.

If the delivery pressure in the conduit 22 rises, the check valve 76 in the by-pass line 74 opens, allowing the reference pressure to rise as well.

In the event of a failure of the delivery hose 26 or the piping 24, the delivery pressure in the conduit 22 drops, causing the actuator 60 to be internally actuated to its operated condition, tripping the pressure differential switch 62 when a sufficient pressure differential exists between the high side and the low side of the actuator 60. Since the actuator 60 may require a slight flow of liquid from the trapping line 68 in order to move the internal components thereof, the bladder 72 charged at a lower pressure will maintain the reference pressure at a proper level within the trapping line 68.

When the pressure differential switch 62 is tripped open, the air valve 88 is likewise opened to exhaust air from the cylinder 92. This allows the cylinder 92 to be retracted by the return spring 96, causing the shut-off valve 18 to be flipped to its closed position. This stops further delivery of fluid through the conduit 22, even though the operating lever 44 is still in the operated position.

It will be appreciated that the reference pressure established in the trapping line 68 may not be the same for all delivery sites, and most likely will not be. However, because the present invention is based upon the differential between such reference pressure and the detected delivery pressure at any particular time, it is of no consequence that the reference pressure may be different at each job site. The amount of change or drop between the reference pressure and that detected by the detector circuit 56 should be essentially the same for all job sites, unless the actuator 60 is adjusted to vary that differential. Thus, variations in back pressure from the storage container, temperature factors, the level of fluid in the cargo tank 14, and other factors can all be accommodated for by the shut-off system 54 of the present invention.

In a preferred embodiment, the time delay relay 104 is set to open after 25–30 seconds of delivery through the conduit 22. This should allow the system to reach a steady state operation such that the delivery pressure will not fluctuate widely from that point on. After that period of time, the pressure existing in the line 68 becomes the reference pressure, unless slightly upwardly adjusted as permitted by the check valve 76 and the assembly by-pass line 74.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of his/their invention as pertains to any apparatus not materially departing from but outside the literal scope of the invention as set out in the following claims.

We claim:

1. In a fluid delivery apparatus for transferring fluid under pressure through a conduit from an outlet of a source of supply to a delivery site, safety shut-off mechanism for closing the outlet in the event of a break in the conduit comprising:

a shut-off valve operably associated with the outlet; and a control system operably coupled with the conduit and the shut-off valve for closing the valve in response to a drop in pressure in the conduit, said control system being responsive to the differential between an established reference pressure and a current delivery pressure in the conduit to close the shut-off valve, said system including a timer operable to delay determination of the reference pressure for a certain predetermined period of time following initiation of the delivery process through the conduit, said system further including a pressure detecting fluid circuit plumbed in parallel with the conduit, said circuit including an actuator, means for communicating working pressure in the conduit with one side of the actuator during the delivery process, and structure for trapping fluid at the reference pressure on an opposite side of the actuator at the termination of the delay period, said actuator being operable, when the difference between the reference pressure on one side of the actuator and the working pressure on its opposite side reaches a predetermined magnitude, to actuate, said shut-off valve including an electrically–powered device, said actuator being operably associated with a switch forming part of an electrical control circuit for said device, said actuator being operable, when actuated, to operate said switch and cause actuation of said device.

2. In a fluid delivery system as claimed in claim 1, said structure further including a fluid flow path communicating said opposite side of the actuator with the conduit, said structure additionally including an electrically powered valve for closing said path at the termination of the delay period.

3. In combination with a truck-mounted fluid transport and delivery apparatus including a tank having an outlet, a shut-off valve associated with the outlet, a delivery conduit, and a pump between the valve and the conduit for pumping fluid out of the tank and through the conduit to a storage container when the valve is open, an on-board safety control system for closing the valve in the event of a break in the conduit, said control system comprising:

a pressure detecting fluid circuit connected with the conduit in a manner to remain in communication with the conduit during delivery; and an operating circuit responsive to pressure changes in the pressure detecting circuit to close the shut-off valve in response to a drop in the pressure in the pressure-detecting circuit, said pressure-detecting circuit including an actuator responsive to the differential between an established reference pressure and a current delivery pressure in the pressure-detecting circuit to close the shut-off valve, said pressure-detecting circuit further including means for communicating current delivery pressure in the conduit with one side of the actuator, a fluid flow path communicating the opposite side of the actuator with the conduit, and a trapping valve in said flow path for trapping a reference pressure in the path between the valve and said opposite side of the actuator when the valve is closed after being initially open during the delivery process, said trapping valve being electrically powered, said operating circuit including a timer operable to delay closing of the trapping valve for a certain period of time following initiation of the delivery process through the conduit.

4. In the combination as claimed in claim 3, said conduit having a check valve permitting fluid flow only in a direction from the truck toward the container, said pressure-detecting circuit having a pair of flow lines connecting with the conduit on opposite upstream and downstream sides of the check valve for simultaneously communicating both sides of the check valve with the pressure-detecting circuit.

5. In the combination as claimed in claim 4, said flow lines each having a one-way restrictor valve therein for restricting the flow from the conduit to the trapping flow path and said one side of the actuator during the delay period but maintaining the lines unrestricted during flow in the opposite direction.

6. In a combination as claimed in claim 4, said trapping flow path having a pressurized accumulator in communication therewith for maintaining the reference pressure in the trapping flow path essentially constant during actuation of said actuator.

7. In a combination as claimed in claim 4, said pressure-detecting circuit further including a by-pass line around the trapping valve and a one-way check valve in said by-pass line to permit the reference pressure to be increased when pressure in the conduit increases after termination of the delay period but to prevent the reference pressure from decreasing when pressure in the conduit decreases after termination of the delay period.

* * * * *